US008260529B2

(12) United States Patent
Tanaya

(10) Patent No.: US 8,260,529 B2
(45) Date of Patent: Sep. 4, 2012

(54) INTERNAL COMBUSTION ENGINE IGNITION CONTROLLING APPARATUS HAVING IGNITION DIAGNOSING FUNCTION

(75) Inventor: Kimihiko Tanaya, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 91 days.

(21) Appl. No.: 12/899,088

(22) Filed: Oct. 6, 2010

(65) Prior Publication Data

US 2011/0247598 A1 Oct. 13, 2011

(30) Foreign Application Priority Data

Apr. 7, 2010 (JP) ..... 2010-088777

(51) Int. Cl.
*F02D 41/22* (2006.01)
*F02P 15/08* (2006.01)

(52) U.S. Cl. .... 701/107; 701/111; 123/636; 123/406.13

(58) Field of Classification Search ..... 123/435, 123/479, 406.13, 406.27, 406.37, 636, 198 D, 123/198 DB, 481; 701/107, 111; 73/35.08, 73/114.08, 114.62, 114.67
See application file for complete search history.

(56) References Cited

U.S. PATENT DOCUMENTS 7,062,373 B2 * 6/2006 Takahashi et al. ..... 701/114
8,014,916 B2 * 9/2011 Tanaya ..... 701/33.6
8,056,396 B2 * 11/2011 Masuda et al. ..... 73/35.03

FOREIGN PATENT DOCUMENTS

JP 3488405 B2 4/2001
JP 2001-280229 A 10/2001

* cited by examiner

*Primary Examiner* — Hai Huynh
(74) *Attorney, Agent, or Firm* — Sughrue Mion, PLLC

(57) ABSTRACT

An ignition controlling apparatus that can diagnose a state of spark discharge in an internal combustion engine, and perform appropriate actions based on the diagnostic results. In the internal combustion engine ignition controlling apparatus, a signal extracting device extracts an ion current that is generated together with combustion of a gas mixture inside a combustion chamber by spark discharge of an ignition apparatus based on an ignition signal of an ignition coil, includes a signal diagnosing device that sets a predetermined detection zone from a period in a single stroke of an internal combustion engine from a first spark discharge commencement until after a last spark discharge completion, and that determines an ignition state based on parameters included in the signal extracted in this detection zone, and controls the internal combustion engine in response to this ignition state.

9 Claims, 6 Drawing Sheets

INTERNAL COMBUSTION ENGINE IGNITION CONTROLLING APPARATUS HAVING IGNITION DIAGNOSING FUNCTION

BACKGROUND OF THE INVENTION

1. Field of the Invention

The present invention relates to an igniting operation that ignites fuel during running of an internal combustion engine, and relates to an ignition controlling apparatus that determines whether this igniting operation is being implemented normally.

2. Description of the Related Art

In recent years, problems of environmental protection and fuel depletion have been raised, and responding thereto has also become a major task in the automotive industry. In response thereto, many techniques have been developed that attempt to raise internal combustion engine efficiency to a maximum. One of these is a stratified charge combustion control method in which flow is controlled such that fuel is distributed only in a vicinity of a spark ignition source (a spark plug), and combustion is generated using a quantity of fuel that is significantly reduced relative to volume of air that is charged inside an internal combustion engine combustion chamber.

A difficulty with stratified charge combustion control is stabilizing the concentration of the fuel in the vicinity of the spark plug. At present, this is difficult to stabilize, and in order to implement stratified charge combustion using existing techniques, it is necessary to adopt either a long electrical discharge method, in which spark discharge is continued until fuel in the vicinity of the spark plug reaches a combustible air-fuel ratio, or a multiple ignition method, in which sparks are repeatedly generated many times.

The above long electrical discharge method is a method in which the ignition coil becomes large and heavy, and there is a practical limit at a discharge time of approximately 2 msec. In contrast, a small, light ignition coil that has superior responsiveness is used in the multiple ignition method, and although single discharge time is short, by generating this repeatedly it is possible to lengthen the discharging zone significantly, and in recent years a tendency to adopt the multiple ignition method has become more pronounced.

However, in the case of multiple ignition systems, each discharging period is often set so as to be short, at approximately 100 to 200 μsec, and if conditions arise in which large capacity components combine on the ignition instruction pathway, ignition interrupting instructions may not be transmitted to the ignition coil as expected, and as a result multiple ignition may not be achieved, leading to deterioration in exhaust gases (emissions) that accompanies deterioration in combustibility, deterioration in fuel consumption that accompanies decline in output, etc., thereby giving rise to problems with regard to environmental protection.

Other techniques for raising engine efficiency include configurations that increase an engine compression/expansion ratio to a limit. A problem with these techniques is that internal portions of the combustion chamber reach extremely high temperatures during the compression cycle and the fuel ignites spontaneously. Combustion due to such spontaneous ignition is extremely fast, and it has been found experimentally that in most cases combustion is completed before the ignition instruction or during the spark discharge immediately after instruction.

As a means of detecting such spontaneous ignition, systems have been proposed that determine spontaneous ignition generating conditions from a state of ions that are formed together with combustion, but since this ion detection is not possible during spark discharge, detection of such spontaneous ignition combustion is enabled by applying multiple ignition to terminate the spark discharge forcibly. Here too, because it becomes impossible to detect spontaneous ignition if ignition interrupting instructions are not transmitted to the ignition coil as expected, as described above, it is consequently impossible to increase the compression ratio of the engine, leading to deterioration in fuel consumption, etc., due to deterioration in thermal efficiency, and compounding the problems with regard to environmental protection.

If intermittent interference from the power supply system wiring is generated in the ignition instruction supply line, then ignition due to passage and interruption of electric current to the ignition coil may be repeated at a timing that is different than the intended ignition timing regardless of the ignition instruction, and in such cases, there is also a possibility that this may lead to damage to the engine.

Consequently, it is necessary to diagnose whether ignition is being performed as intended.

[Patent Literature 1]

Japanese Patent No. 3488405 (Gazette)

The apparatus that is shown in the above patent literature diagnoses operation of an ignition coil by detecting an impulse signal that is generated together with operation of the ignition coil, and can determine when the ignition coil is not operating at all. However, it cannot determine whether or not the multiple ignition that has been described above has been implemented. Since the impulse signal that accompanies ignition is generated if the last spark is implemented even if multiple ignition has not been achieved, the apparatus that is shown in the patent literature is limited to determination of normal ignition, and cannot determine when multiple ignition is abnormal.

There are also cases in which the apparatus that is shown in the patent literature cannot correctly determine when the ignition coil is operating in an unintended manner. When the spark plug is in a clean state, even the apparatus that is shown in the patent literature can determine abnormal ignition if the igniting operation has not been performed within a set detection period. However, if a conducting pathway has formed between a center electrode and ground of the spark plug due to carbon, etc., there are cases in which leakage current flows during the detection period even if the igniting operation has not been implemented within the detection period, and another problem has been that the apparatus that is shown in the patent literature mistakes this leakage current for the signal that accompanies the igniting operation and cannot determine that the igniting operation is abnormal.

SUMMARY OF THE INVENTION

The present invention aims to solve such problems as those described above and provide an internal combustion engine ignition controlling apparatus that has an ignition diagnosing function that can detect whether satisfactory spark discharge is performed, and repair faults by notification of abnormality, and that can consequently contribute to environmental protection because target engine efficiency can be achieved.

In order to achieve the above object, according to one aspect of the present invention, there is provided an internal combustion engine ignition controlling apparatus having an ignition diagnosing function, the ignition controlling apparatus including: an ignition apparatus that generates a spark discharge for igniting fuel that has been supplied into an internal combustion engine combustion chamber; an ignition coil that generates and applies to the ignition apparatus a high voltage for generating the spark discharge; a controlling apparatus that issues an ignition signal to the ignition coil a plurality of times in a single stroke; a bias device that is disposed on the ignition coil and that generates and applies to the ignition apparatus a bias voltage that has a reverse polarity to a polarity of the high voltage; a signal extracting device that is disposed on the controlling apparatus and that extracts a signal that is generated as a result of application of the bias voltage; and a signal diagnosing device for diagnosing a state of the spark discharge based on output from the signal extracting device, the ignition controlling apparatus being characterized in that: the signal extracting device sets a predetermined detection zone from a period within the stroke of the internal combustion engine from a first spark discharge commencement until after a last spark discharge completion, and extracts a signal in the detection zone; and the signal diagnosing device determines a state of ignition using parameters included in the extracted signal in the predetermined detection zone, and controls the internal combustion engine in response to the determination.

According to an internal combustion engine ignition controlling apparatus that has an ignition diagnosing function according to the present invention, because whether spark discharge is being performed normally can be detected, faults can be repaired due to notification of abnormalities, and because target engine efficiency can be achieved, a contribution can consequently be made to fuel depletion problems and environmental protection.

DETAILED DESCRIPTION OF THE PREFERRED EMBODIMENTS

Embodiment 1

Embodiment 1 of the present invention will now be explained with reference to the drawings.

Figure 1:
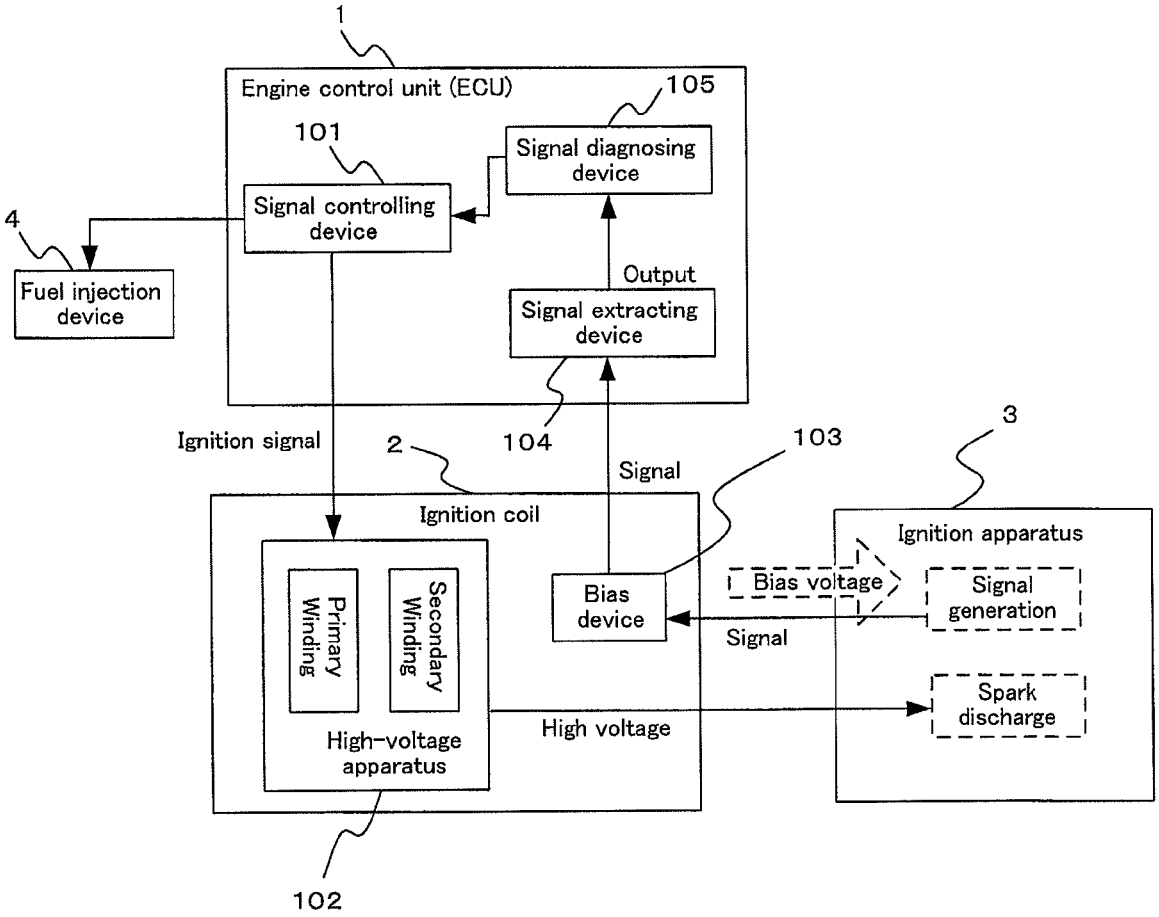
FIG. 1 is an overall configuration diagram of an ignition controlling apparatus according to preferred embodiments of the present invention.

FIG. 1 is a diagram that shows an overall configuration of an apparatus according to the present invention, and 1 represents a controlling apparatus that controls input and output of various kinds of signal, generally called an engine control unit (ECU). 2 represents an ignition coil, and 3 represents an ignition apparatus (a spark plug), an ignition controlling apparatus being configured by these three apparatuses. 4 represents a fuel injection device. A signal controlling device 101 inside the ECU 1 generates an ignition signal which is an instruction signal for operating the ignition coil 2. When the ignition signal is in a "High" state, the ignition coil 2 commences energy accumulation by an electric current (a primary current) flowing through a primary winding inside the ignition coil, and the ignition coil 2 generates a high voltage of approximately 30 kV, for example, in an internal high-voltage apparatus 102 at a timing (ignition timing) at which the ignition signal switches from "High" to "Low".

The high voltage that is generated by the ignition coil 2 is transmitted to the spark plug 3, and a spark discharge that is due to dielectric breakdown between the spark plug electrode and ground is generated by this high voltage, giving rise to ignition and combustion of a combustible gas mixture inside a combustion chamber. Accompanying this spark discharge operation, a bias device 103 that is inside the ignition coil 2 generates a bias voltage, a constant voltage of approximately 100 V, for example, for detecting ions that are formed together with the combustion of the combustible gas mixture inside the combustion chamber, and supplies it to the spark plug 3 after completion of the spark discharge. In addition to a spark discharging function, the spark plug 3 also includes a probing function for detecting ions, and detects the ions that are formed together with the combustion of the combustible gas mixture by applying the bias voltage between the spark plug electrode and ground.

The ions that are detected by the spark plug 3 flow from the spark plug 3 through the bias device 103 inside the ignition coil 2 as an electric current signal. Hereinafter, this electric current signal will be called "the ion current". The ion current is also amplified by the bias device 103 inside the ignition coil 2, and is transmitted to a signal extracting device 104 inside the ECU 1.

The signal extracting device 104 converts the input ion current into an ion signal that is in voltage form so as to enable processing by a microcomputer, and extracts various information such as signal generation magnitude, timing of generation and completion, period, etc., for example. A signal diagnosing device 105 performs an ignition diagnosis based on the extracted information. This diagnostic method will be described below.

The signal extracting device 104 also controls the rate at which the ion current is converted into the voltage signal. Consider when the ion signal is passed through an analog-to-digital (A/D) converter for processing by the microcomputer. The signal extracting device 104 converts the ion current into a voltage value between 0 V and 5 V using the A/D converter, but since the ion current increases at high rotation, for example, if the conversion rate is constant, 5 V may be exceeded in the voltage conversion and the signal may become saturated at 5 V. Consequently, the signal extracting device 104 has a function that monitors the saturation state of the signal, and modifies the current/voltage conversion rate to adjust the signal so as not to become saturated if it determines that the saturated state is being reached frequently, or alternatively in response to operating conditions such as engine rotational speed, load, etc., based on preverified matching results. The signal extracting device 104 may also be set so as to switch the conversion rate when the applied voltage for detecting the ion current changes significantly, for example, when the ignition signal is in a "High" state and in a "Low" state.

Figure 2:
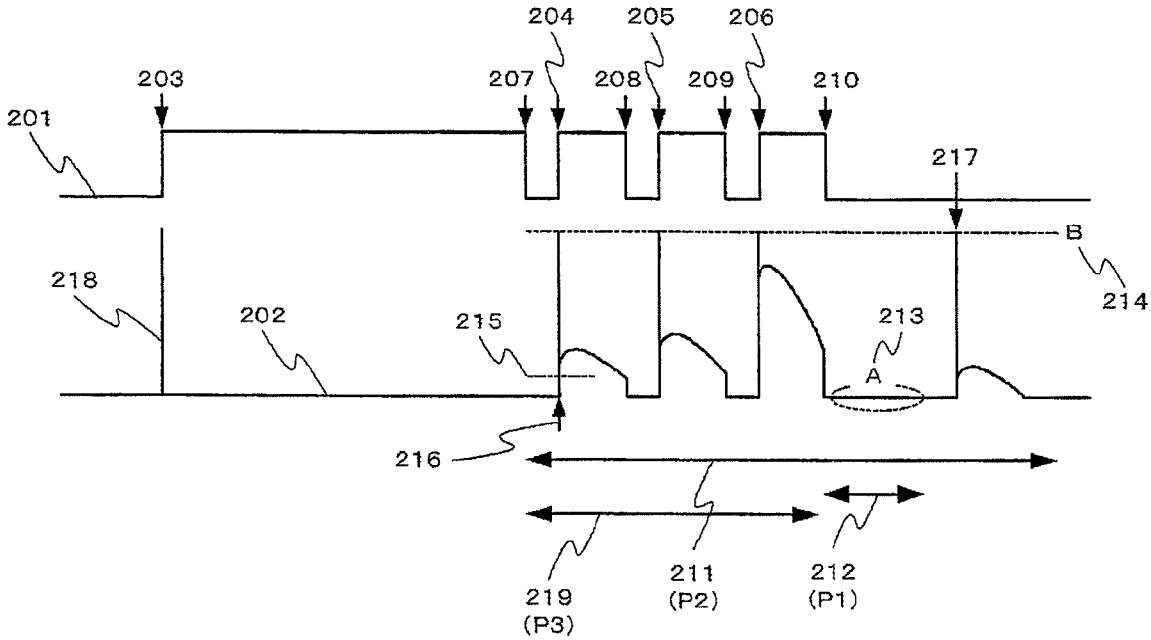
FIG. 2 is shows ignition signal and ion current waveforms according to Embodiment 1.

FIG. 2 is a signal waveform example. Signal 201 is an ignition signal, signal 202 is an ion signal, the horizontal axis represents crank angle or time, and the vertical axis represents voltage value. Here, the signal controlling device 101 supplies a multiple ignition signal 201 such as that shown in FIG. 2 to the ignition coil 2 in order to improve combustion diagnosing performance. By recommencing passage of the primary current at timing 204 after a predetermined period from a first ignition 207, approximately 0.05 msec, for example, has elapsed, a spark discharge that is generated by the first ignition 207 can be forcibly terminated at timing 204, and although noise is generated, detection of the ion signal can be made possible from timing 204.

If the compression ratio is increased in order to increase thermal efficiency of the internal combustion engine, the voltage required for spark discharge (dielectric breakdown across the spark plug) increases. Because of this, it is necessary to inject more energy into the ignition coil, and inevitably the spark discharge time is also longer, and has nominal characteristics of approximately 2 to 3 msec, for example. The ion signal cannot be detected during this spark discharging period. In contrast to that, since combustion speed is extremely fast in abnormal combustion, generation of the ion signal, which represents the combustion state in the vicinity of the center electrode of the spark plug 3, is also extremely abrupt and short, sometimes being generated and completed within 2 msec from main ignition, and it may not be possible to distinguish between a misfire state and an abnormal combustion state. In other words, one major problem has been that abnormal combustion detection that is especially required in internal combustion engines of this kind that have a high compression ratio is obstructed by characteristics of the spark discharge and cannot be achieved. However, the above problem can be solved by applying multiple ignition as described above, and recommencing passage of the primary current to terminate the spark discharging period forcibly.

Let us return to the explanation of FIG. 2. Timings 203 through 206 in the ignition signal 201 represent primary current passage commencement timings, and timings 207 through 210 represent primary current interruption timings. An ion signal extraction zone includes: the first interruption timing (the first ignition) 207 through the last interruption timing (the final ignition) 210, and the timing 217 at which the spark discharge is completed, and is set as zone 211 in FIG. 2 (P2, corresponding to a second detection zone). Zone 212 from the final ignition 210 until timing 217 at which the spark discharge is completed is also set (P1, corresponding to a first detection zone).

Next, details of the diagnostic processing in the signal diagnosing device 105 will be explained using the flowchart in FIG. 3 and the timing chart in FIG. 2. The signal diagnosing device 105 is a device that determines whether ignition is normal or abnormal based on parameters such as maximum value, minimum value, generation timing, etc., of the ion signal.

Figure 3:
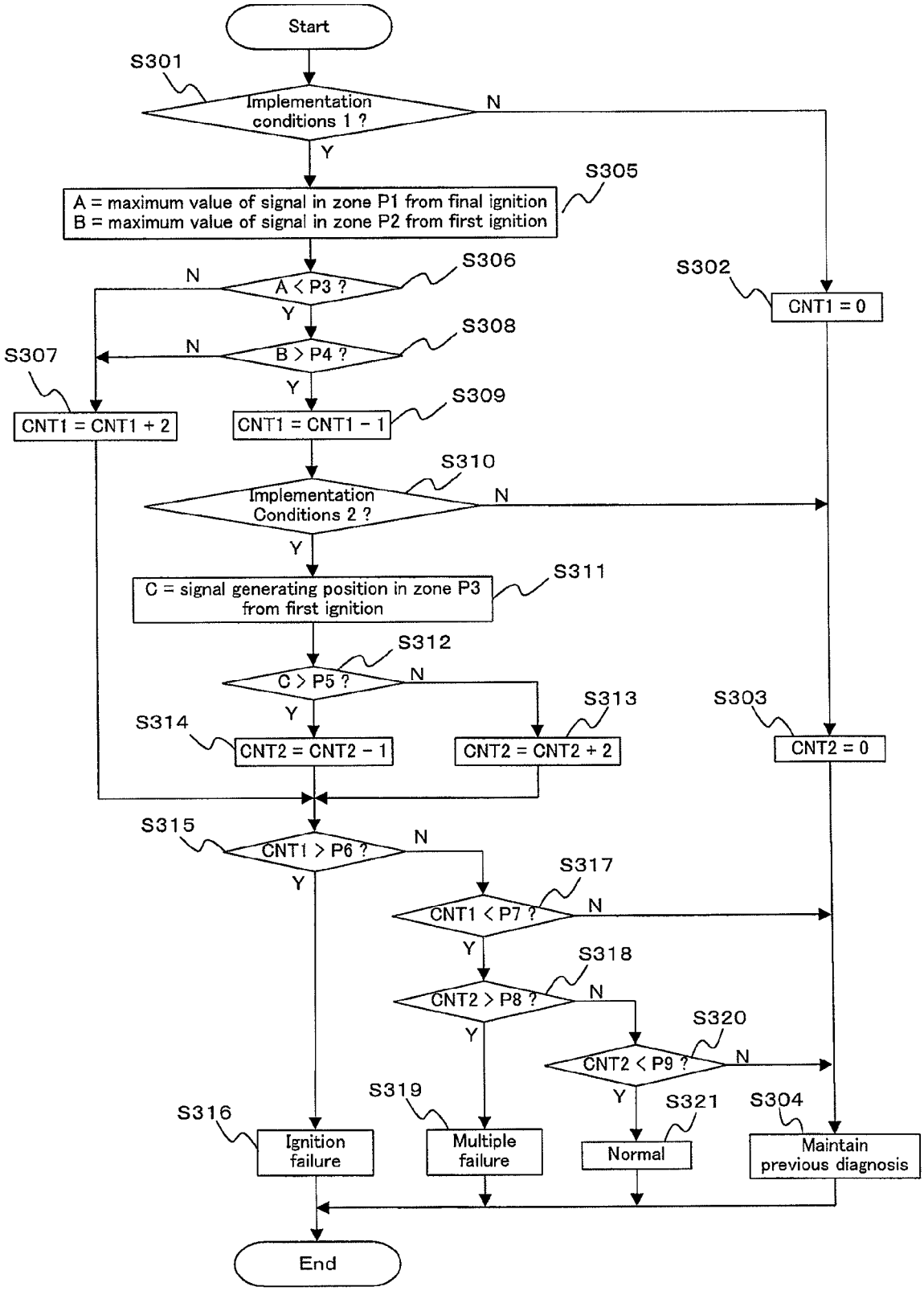
FIG. 3 is a flowchart of ignition diagnostic processing according to Embodiment 1.

At S301 in FIG. 3, first determine whether conditions for implementing ignition diagnosis are being met. For example, during an ignition cut, it is assumed that an ignition diagnosis will not be implemented. It is preferable for the A/D sampling to be time-sampled at a period smaller than 50 μsec. However, in cases in which the A/D sampling is synchronized with the crank angle due to circumstances, etc., the lower the engine speed, the longer the sampling period, and important information may be missed such as impulse signals, for example, that are generated at spark discharge termination, such as 217 in FIG. 2. Consequently, in such cases, it is assumed that ignition diagnosis will not implemented at or below a predetermined rotational speed, or during a fuel cut. Alternatively, the probability of missing a signal due to sampling problems can be reduced by also checking whether a signal that exceeds a predetermined threshold value, a signal such as 218, for example, has been generated within a predetermined zone around timing 203 in FIG. 2 at or below a predetermined rotational speed.

At S301, if it is determined that the above implementation conditions 1 are not being met (N), proceed to S302, and set CNT1 to 0, at S303 set CNT2 to 0, and at S304 maintain the previous diagnostic result, then end. CNT1 and CNT2 are counters, and are incremented when ignition is abnormal, and are decremented when normal. Details will be described below.

If it is determined at S301 that the implementation conditions 1 are being met (Y), then proceed to S305 and find the maximum value of the signal in zone P1 from final ignition as A and the maximum value of the signal in zone P2 from first ignition as B, respectively. Here, final ignition indicates timing 210 in the example in FIG. 2, and first ignition indicates timing 207. Zone P1 is set so as to be zone 212 in the example in FIG. 2, and zone P2 is zone 211, maximum value A being 213 and maximum value B being 214. Zones P1 and P2 may be set in advance as map values that correspond to rotational speed and load. Because noise due to the high voltage generation is sometimes carried on the signal in the primary current interruption timings, P1 zone 212 and P2 zone 211 may be set in advance so as not to include timing 210 and timing 207, respectively, or alternatively may be set so as to commence from a predetermined amount of time, 100 μsec, for example, from timing 210 and timing 207, respectively.

Proceed to S306 and if value A is greater than or equal to a comparison level P3 (N), then determine that there is a possibility that ignition is abnormal, proceed to S307, and increment CNT1. At S306, if value A is smaller than the comparison level P3 (Y), then proceed to S308, and further compare value B with a comparison level P4. If value B is less than or equal to the comparison level P4 (N), then assume there is a possibility that ignition is abnormal, proceed to S307 and increment CNT1 in a similar manner, and then proceed to S315. If value B is greater than the comparison level P4 at S308 (Y), then determine that there is a possibility that ignition is normal, proceed to S309, and decrement CNT1. The comparison levels P3 and P4 may be set to variables or map values that are determined in response to rotational speed, load, and the rate at which the ion current is converted into the voltage signal, etc.

Here, a clip that has upper and lower limits is predisposed on the counter CNT1. The lower limit is set to 0, and the upper limit is set to a value such as 10, for example. If the upper limit of the clip is set so as to be large, it becomes harder to return to normal state determination, enabling the setting to be made safer. It is also preferable if the amount of increment and the amount of decrement of CNT1 described above can be set separately. In FIG. 3, the amount of increment is set to 2, and the amount of decrement is set to 1, so as to establish a hysteresis such that a determination of abnormality is easily passed, and a normal state determination is difficult to restore. The amounts of increment or decrement or the clip values at the upper and lower limits may also be set as variables or map values that are determined in response to rotational speed and load.

Proceed to S310. At S310, once again perform a determination of the implementation conditions, and a determination of the multiple ignition implementation conditions. In conditions in which multiple ignition is not being implemented, or in which the interval from the first ignition to the final ignition is short and the spark discharging period is extremely short, for example, cases in which short-interval multiple ignition is implemented only once when operating conditions are at high rotational speed or heavy load where the voltage required for spark discharge increases significantly, or cases in which the interval from the first ignition to the commencement of passage of current of the second ignition is set so as to be just long enough that spark discharge time does not force termination and the interval from the commencement of passage of current of the second ignition to the second ignition is set so as to be short, when consideration is given to various kinds of irregularities, there is a possibility that there may be an erroneous determination because position C at which a signal is generated as described below is generated at a timing that is close to when multiple ignition might be either abnormal or normal, and it is assumed that a determination will not be implemented in such cases (N), proceed to S303 and continue as above. If the conditions are met at S310 (Y), then proceed to S311, and find the position C at which the signal is generated in zone 219 from the first ignition to the final ignition (P3, a third detection zone). For example, in the example in FIG. 2, timing 216 at which the signal is first generated that exceeds the threshold value 215 at 219 in zone P3 after the first ignition 207 is obtained as value C. Here, detection zone P3 may also be set so as to be identical to zone P2 (211) described above.

Assuming that a BTDC (before top dead center) direction is a forward direction of the timing, if the value C at S312 is less than a comparison level P5, that is, on a retarded side (N), then determine that there is a possibility that multiple ignition is abnormal, and proceed to S313, and increment CNT2. If (Y) at S312, determine that there is a possibility that multiple ignition is normal, proceed to S314, decrement CNT2, and then proceed to S315. Here, upper and lower limit clips may also be disposed on the counter CNT2 in a similar manner to CNT1, and the amounts of increment or decrement, the upper and lower clip values, and the comparison level P5 may also be set as variables or map values that are determined in response to rotational speed and load.

At S315, if CNT1 is greater than a comparison value P6 (Y), then proceed to S316, determine that ignition has failed, that is, that ignition is not being generated at all at the instructed timing, then end. If (N) at S315, proceed to S317, and if CNT1 is greater than or equal to a comparison value P7 (N), then proceed to S304, maintain the previous determined result, then end. If (Y) at S317, proceed to S318, and if CNT2 is greater than a comparison value P8 (Y), proceed to S319, determine that multiple ignition has failed, that is, ignition is generated, but it is not multiple ignition as instructed, then end. If (N) at S318, proceed to S320, and if CNT2 is greater than or equal to a comparison value P9 (N), proceed to S304, maintain the previous diagnosis and end, and if (Y) at S320, proceed to S321, determine that ignition is normal, and end. The comparison values P6 through P9 may also be set as variables or map values that are determined in response to rotational speed and load.

The state of ignition is diagnosed as described above, and if it is determined that the state of ignition is ignition failure, then the ECU 1 cancels fuel injection instructions to the fuel injection device 4. In other words, the ECU 1 issues an instruction such that fuel is not supplied to the cylinder that is subject to ignition failure until a determination that ignition is normal is issued. Because it is necessary to determine whether ignition has been restored to normal, instructions to the ignition coil 2 continue to be issued as per normal.

If the state of ignition is multiple ignition failure, then the ECU 1 prohibits preignition detection processing such as that described above and performs control to maintain an operating state in which abnormal combustion such as preignition is reliably prevented such as ensuring that load is not increased, delaying closing timing of intake air valve timing, making the air-fuel ratio of the air-fuel mixture richer, delaying fuel injection timing, etc., for example.

Embodiment 2

A method in which misfire diagnosis results from a misfire detecting means are added to the ignition diagnosing method that is shown in Embodiment 1 will be explained based on FIG. 4. Because the flowchart that is shown in FIG. 4 is basically similar to the flowchart that is shown in FIG. 3, differences from FIG. 3 will be focused on and explained.

Figure 4:
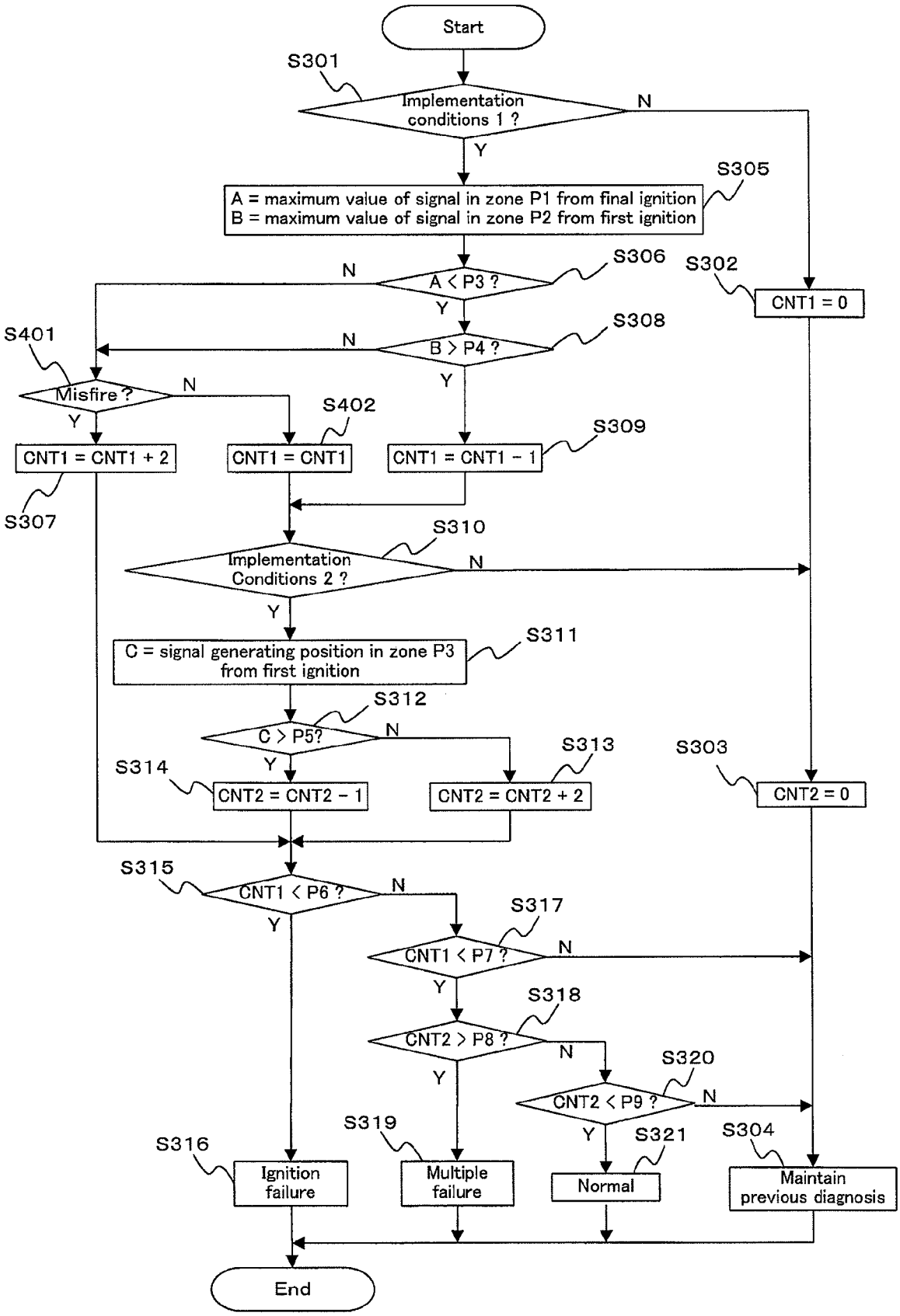
FIG. 4 is a flowchart of ignition diagnostic processing according to Embodiment 2.

If it is determined at S306 in FIG. 4 that value A is greater than or equal to the comparison value P3 (N), then determine that there may be ignition failure, and proceed to S401. Here, if it is determined, using the determination of the misfire detecting means, that a misfire has occurred (Y), then the possibility of ignition failure is deemed to be higher, proceed to S307, increase the counter value of CNT1, and proceed to S315. On the other hand, if a misfire has not occurred at S401 (N), then a conflict has occurred between the ignition diagnosis and the misfire diagnosis, in other words, determine that it is very likely that the abnormality, which cannot be determined, is in the ion signal pathway, for example, not the ignition system, proceed to S402, maintain the counter value of CNT1, then proceed to S310, and enter multiple ignition diagnostic processing. The misfire at S401 may be based on the results of misfire detection by rotational fluctuation, etc., or may also be based on the results of misfire detection using the ion signal. Examples of misfire detection methods using the ion signal include, for example, methods that determine there has been a misfire if the time that the ion signal in zone 211 in FIG. 2 exceeds the threshold value 215 continuously is less than a predetermined amount of time, i.e., 500 μsec, for example, or if the total time the threshold value 215 is exceeded is less than a predetermined amount of time, i.e., 1 msec, for example. The threshold value 215 may also be a value that changes in response to operating conditions or a carbon deposition condition of the spark plug.

All other processing is similar to that in FIG. 3.

By using a misfire detection determination as in Embodiment 2, ignition system diagnostic precision can be further improved, enabling false diagnosis to be prevented.

Embodiment 3

Embodiment 3 will be explained based on FIGS. 5 and 6. In Embodiment 1, for microcomputer computational load reduction inside the ECU 1, it was determined that multiple ignition is abnormal if a signal generation position C is less than a comparison level P5, that is, retarded, but multiple ignition diagnosis can be performed more accurately using parameters such as an impulse signal generation count such as 501 in FIG. 5 that is generated together with the igniting operation inside the multiple ignition zone and an instruction count and timing of multiple ignition. A specific method will be explained.

Figure 5:
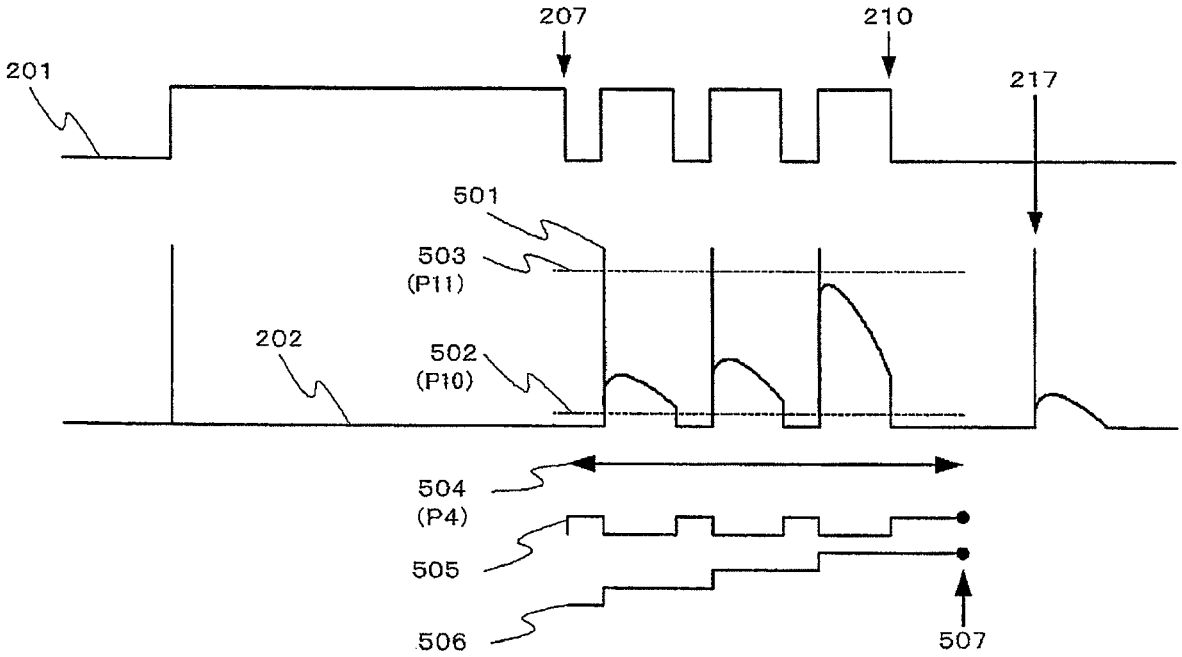
FIG. 5 is a timing chart of ignition diagnostic processing according to Embodiment 3.
Figure 6A:
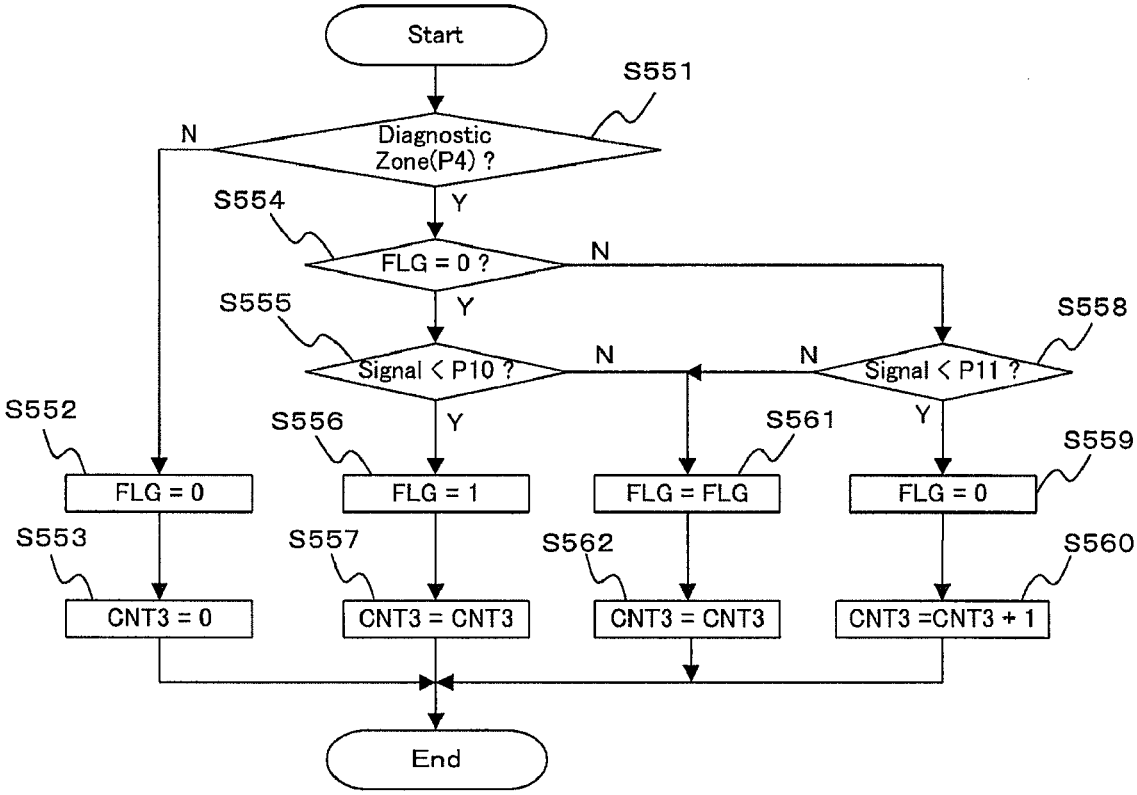
FIG. 6A is a flowchart of the ignition diagnostic processing according to Embodiment 3.

With reference to the timing chart in FIG. 5, comparison levels 502 (P10) and 503 (P11) relative to the signal 202 and a multiple ignition diagnostic zone 504 are set, and an impulse signal count is counted (CNT3) in accordance with the flowchart in FIG. 6A.

First, at S551, check whether the diagnostic zone is present. The diagnostic zone (FIG. 5, 504, a fourth detection zone) is a predetermined zone that can be set from a first spark discharge commencement timing 207 until on or after a last spark discharge commencement (210) and that does not include a signal 217 that accompanies spark discharge termination.

In comparison with zone 211 (P2) zone in FIG. 2 in Embodiment 1, an endpoint differs, and the diagnostic zone (504) is a shorter zone. If outside the diagnostic zone at S551 in FIG. 6A (N), then proceed to S552 and S553, initialize a flag FLG, which represents a compared result between the comparison levels and the signal, to 0, and the counter CNT3 to 0. If inside this zone at S551 (Y), then proceed to S554, and if the flag FLG is 0 (Y), then to S555, and if the signal is also less than the comparison level P10 (Y), then proceed to S556 and S557, set FLG to 1, and maintain CNT3 without modification, then end. If, on the other hand, the flag FLG is not 0 at S554 (N), then go to S558, and if the signal exceeds the comparison level P11 (Y), then proceed to S559 and S560, reset FLG to 0, increment CNT3 by one, and end. If (N) at S555 or S558 proceed to S561 and S562, maintain both FLG and CNT3, and end.

By the operation thus far, a count that is generated each time the signal is switched off can be counted as CNT3. Specifically, an impulse signal generation count can be counted that looks like 505 (FLG) and 506 (CNT3) that are shown in FIG. 5 when the movement of FLG and CNT3 is expressed as a time series.

Figure 6B:
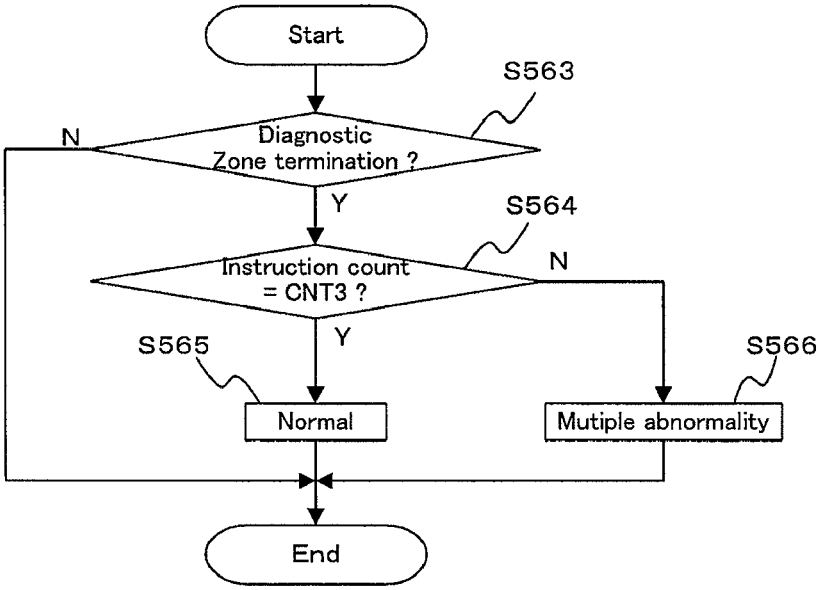
FIG. 6B is a flowchart of the ignition diagnostic processing according to Embodiment 3.

On reaching a diagnostic zone end point 507, in accordance with the flowchart in FIG. 6B, diagnostic zone termination is reached (Y) at S563, proceed to S564, and if the multiple ignition instruction count and the signal generation count CNT3 match (Y), then multiple ignition can be diagnosed as being normal (S565), and if they do not match (N), then multiple ignition can be diagnosed as being abnormal (S566). Alternatively, diagnostic precision can be further improved by recording the timings at which CNT3 is updated in addition to the count number (CNT3), comparing these with instructed timings, and checking whether differences between these timings are within a predetermined error range.

According to Embodiment 3, whether multiple ignition is implemented as intended can be diagnosed precisely.

According to the apparatus of the present invention, because the state of spark discharge in an internal combustion engine can be diagnosed and appropriate actions can be performed based on the diagnostic results, direct discharge of unused fuel into the atmosphere is prevented, and damage to catalysts that purify exhaust gases can be prevented, and because target engine efficiency can be achieved, etc., a contribution can consequently be made to environmental protection.

Because an ignition diagnosing apparatus according to the present invention can be mounted to automobiles, motorcycles, outboard motors, and other special machines, etc., that use an internal combustion engine, and can reliably perform ignition function diagnosis, the internal combustion engine can be operated efficiently, enabling a contribution to be made to fuel depletion problems and environmental protection.

What is claimed is:

1. An internal combustion engine ignition controlling apparatus having an ignition diagnosing function, said ignition controlling apparatus comprising:

an ignition apparatus that generates a spark discharge for igniting fuel that has been supplied into an internal combustion engine combustion chamber;

an ignition coil that generates and applies to said ignition apparatus a high voltage for generating said spark discharge;

a controlling apparatus that issues an ignition signal to said ignition coil a plurality of times in a single stroke;

a bias device that is disposed on said ignition coil and that generates and applies to said ignition apparatus a bias voltage that has a reverse polarity to a polarity of said high voltage;

a signal extracting device that is disposed on said controlling apparatus and that extracts a signal that is generated as a result of application of said bias voltage; and a signal diagnosing device for diagnosing a state of said spark discharge based on output from said signal extracting device, wherein:

said signal extracting device sets a predetermined detection zone from a period within said stroke of said internal combustion engine from a first spark discharge commencement until after a last spark discharge completion, and extracts a signal in said detection zone; and said signal diagnosing device determines a state of ignition using parameters included in said extracted signal in said predetermined detection zone, and controls said internal combustion engine in response to said determination.

2. An internal combustion engine ignition controlling apparatus having an ignition diagnosing function according to claim 1, wherein:

said signal extracting device sets a first detection zone that can be set from a last spark discharge commencement until on or before a last spark discharge is completed within a single compression or combustion stroke, extracts a first generation magnitude of said signal within said first detection zone, and sets a second detection zone that includes timings from said first spark discharge commencement until said last spark discharge is completed, and extracts a second generation magnitude of said signal within said second detection zone; and said signal diagnosing device determines that said spark discharge is not being implemented normally if said first generation magnitude of said signal is greater than a predetermined first comparison magnitude, or if said second generation magnitude is less than a predetermined second comparison magnitude.

3. An internal combustion engine ignition controlling apparatus having an ignition diagnosing function according to claim 1, wherein when said controlling apparatus controls said ignition apparatus so as to generate a plurality of spark discharges within a single compression or combustion stroke, said signal extracting device sets a third detection zone that can be set on or after a timing that commences a first spark discharge, and extracts a generation timing of said signal within said third detection zone, and said signal diagnosing device determines that said plurality of spark discharges are not being generated if said extracted signal generation timing is later than a predetermined comparison timing.

4. An internal combustion engine ignition controlling apparatus having an ignition diagnosing function according to claim 3, wherein said signal diagnosing device prohibits diagnosing a state of generation of said plurality of spark discharges if generation timing of said first spark discharge and completion timing of said last spark discharge are shorter than a predetermined period when said ignition apparatus is generating a plurality of spark discharges within a single compression or combustion stroke.

5. An internal combustion engine ignition controlling apparatus having an ignition diagnosing function according to claim 1, wherein said controlling apparatus performs control so as to continue operating instructions to said ignition coil as per normal and stop fuel supply to said combustion chamber if it is determined by said signal diagnosing device that there is an abnormality.

6. An internal combustion engine ignition controlling apparatus having an ignition diagnosing function according to claim 1, wherein said controlling apparatus is an apparatus that detects abnormal combustion based on said extracted signal when generating a plurality of ignition signals within a single compression or combustion stroke, and that performs control so as to avoid abnormal combustion based on said detected result, and prohibits detection of abnormal combustion and performs control such that an operating state of said internal combustion engine does not generate abnormal combustion if it is determined by said signal diagnosing device that said plurality of spark discharges are not being generated normally.

7. An internal combustion engine ignition controlling apparatus having an ignition diagnosing function according to claim 1, wherein:

said signal extracting device sets a first detection zone that can be set from a last spark discharge commencement until on or before a last spark discharge is completed within a single compression or combustion stroke, extracts a first generation magnitude of said signal within said first detection zone, and sets a second detection zone that includes timings from said first spark discharge commencement until said last spark discharge is completed, and extracts a second generation magnitude of said signal within said second detection zone; and said signal diagnosing device further comprises a misfire detecting means that detects a misfire, and determines that said spark discharge is not being implemented normally if said misfire detecting means has determined that there has been a misfire, and said first generation magnitude of said signal is greater than a predetermined first comparison magnitude or said second generation magnitude is less than a predetermined second comparison magnitude.

8. An internal combustion engine ignition controlling apparatus having an ignition diagnosing function according to claims 1, wherein said controlling apparatus further comprises a misfire detecting means that detects a misfire, and performs control so as to continue operating instructions to said ignition coil as per normal and stop fuel supply to said combustion chamber if said misfire detecting means has determined that there has been a misfire, and it is determined by said signal diagnosing device that there is an ignition abnormality.

9. An internal combustion engine ignition controlling apparatus having an ignition diagnosing function according to claim 1, wherein when said controlling apparatus is performing control such that a plurality of spark discharges are generated by said ignition apparatus within a single compression or combustion stroke, said signal extracting device sets a fourth detection zone from said first spark discharge to before said last spark discharge is completed, and extracts at least one of either a generation timing or a generation count of said signal within said fourth detection zone, and said ignition diagnosing apparatus determines that said plurality of spark discharges are not being generated as controlled if at least one is satisfied of either a difference between said generation timing of said signal and a timing that is instructed by said controlling apparatus differing by greater than or equal to a predetermined zone, or said signal generation count being different from a spark discharge count that is instructed by said controlling apparatus.

* * * * *